United States Patent [19]

John et al.

[11] Patent Number: 4,473,013

[45] Date of Patent: Sep. 25, 1984

[54] INCINERATOR STEAM GENERATION SYSTEM

[75] Inventors: Floyd C. John; Scott R. Taylor, both of Ogden; Gerald B. Taggart, Eden, all of Utah

[73] Assignee: Clear Air, Inc., Ogden, Utah

[21] Appl. No.: 515,571

[22] Filed: Jul. 20, 1983

Related U.S. Application Data

[62] Division of Ser. No. 396,421, Jul. 8, 1982, Pat. No. 4,952,152.

[51] Int. Cl.[3] ..... F23G 3/00; F23J 1/02; F23K 7/04

[52] U.S. Cl. ..... 110/235; 110/171; 110/213; 110/291

[58] Field of Search ..... 110/267, 283, 288, 291, 110/300, 235

[56] References Cited

U.S. PATENT DOCUMENTS

| | | | |
|---|---|---|---|
| 1,623,424 | 4/1927 | Lundgren | 110/300 |
| 1,629,282 | 5/1927 | Lundgren | 110/291 |
| 1,664,082 | 3/1928 | Mildon | 110/291 |
| 2,282,157 | 5/1942 | Bennett | 110/291 |
| 2,528,292 | 10/1950 | Arnold et al. | 110/291 |
| 3,543,700 | 12/1970 | Baigas, Jr. | 110/213 |
| 4,170,183 | 10/1979 | Cross | 110/291 |
| 4,213,402 | 7/1980 | Kochey | 110/171 |
| 4,387,651 | 6/1983 | Moore | 110/171 |

*Primary Examiner*—Henry C. Yuen

*Attorney, Agent, or Firm*—M. Ralph Shaffer

[57] ABSTRACT

A new and improved incinerator steam generation system subjecting to combustion debris such as municipal waste, utilizing the heat derived therefrom to produce steam for steam boiler, electrical generating facilities, heating facility for industrial or commercial plants, and so forth. This is provided with a series of boilers and controls, both manually adjustable and also automatic, whereby the possiblity of fire dangers are minimized, created temperature ranges of boiler gases are constrained to desirable limits, dump stack facilities are automatically controlled as to particular effectiveness for differing types of operating conditions, and where safety features are incorporated to shut down gas flow through the boiler during periods of boiler-water deficiency, excess steam generation relative to demand, and other conditions. Within the furnace area proper the pressure conditions are predetermined and are controlled during operation for desired efficiency, vapor removal, and materials' combustion. Thus, air-entrained particulates are minimized, and combustible gases as produced at the grate areas of the furnace are driven off for later, secondary combustion. Temperature control of resulting gases is maintained.

2 Claims, 4 Drawing Figures

INCINERATOR STEAM GENERATION SYSTEM

This is a division of application Ser. No. 06/396,421 filed 07/08/82 of same title, now U.S. Pat. No. 4,952,152.

FIELD OF INVENTION

The present invention relates to incinerators and particularly incinerators for producing steam generation to accomplish any one or more of a number of utilitarian purposes.

BRIEF DESCRIPTION OF PRIOR ART

Furnaces and incinerators usable for producing steam are well known in the art. No patents are known to the inventors, however, relative to the specific features pointed out with particularity and claimed herein. The prior art facilities as these are known have contributed to fire dangers, inadequacy of control, and importantly, absence of features of desired automatic control to satisfy the several operating parameters that may be present. Of course, inattention in the past had been all to pervasive so far as accommodating any one of a number of possible operating conditions, steam demand requirements, and so on, which would alter the effectiveness of present-day steam generation systems as these are known. Finally, the prior art has not addressed the problem of air pollution and its control in the absence of usual scrubbers and allied equipment.

BRIEF DESCRIPTION OF THE PRESENT INVENTION

Accordingly, the present invention is directed to an incineration-steam generation plant or equipment which is unusually versatile and suitable for operating in a wide varieties of locations and under different types of conditions. This system takes cognizance of the fact that feed-stock of highly differing BTU content and moisture content can be accommodated. Further, fire dangers, thermal shock to equipment, and boiler malfunction are all taken into consideration. Indeed, the system uniquely utilizes the automatic control of gases flow through the dump stack utilized. Additional innovative features are found in the complete or controlled interruption of gas flow presented, in the regulation of temperature conditions in the gas flow accommodating the boiler, in pressure-sensing gas flow to utilize and control temperature conditions at several points, and, furthermore, to reduce if not essentially eliminate particulate entrainment in ascending gases coming from the combustion area of the furnace. The furnace itself is divided essentially into zones, a vapor drive-off or drying zone, a combustion zone, and also a final residual zone. The construction is such that eddy currents and other types of marked gases' flow are reduced in areas where particulate pick-up and entrainment are chanced; in addition, the point of gases' exhaustion into a secondary chamber, where the gases are subjected to combustion, is chosen to be where vapors are driven off and particulate entrainment can be minimized.

OBJECTS

Accordingly, a principal object of the present invention is to provide a new and improved incinerator.

A further object is to provide a new and improved incinerator boiler structure.

An additional object is to provide for manual and/or automatic controls for an incinerator in a manner to reduce fire danger, air-pollution, and so forth.

An additional object is to provide for an incinerator-boiler structure which is conducive to proper operation in a wide variety of locations and for a wide variety of conditions, BTU feed content, moisture present in feed, and so forth.

An additional object is to provide suitable controls for diverting and otherwise controlling at a dump stack, and this automatically, oncoming gases, this to effect a number of desirable conditions.

A further object is to provide an incinerator-boiler system wherein the range of temperature control of the gas at approximately the boiler-gas input point can be maintained accurately and automatically in accordance with controlled incinerator operation.

A further object is to provide separate zones for subjecting to combusiton solid materials and also for subjecting to combustion any gases driven off from such materials.

A further object is to maintain essentially quiescent air pressure zones above the grate of an incinerator so as to substantially reduce particulate entrainment which otherwise exist for any drafts occurring proximate the combustion and residual zones of the grate.

BRIEF DESCRIPTION OF THE DRAWINGS

The present invention may best be understood by reference to the following description, taken into consideration with the accompanying drawings in which.

DESCRIPTION OF PREFERRED EMBODIMENTS

Figure 1:
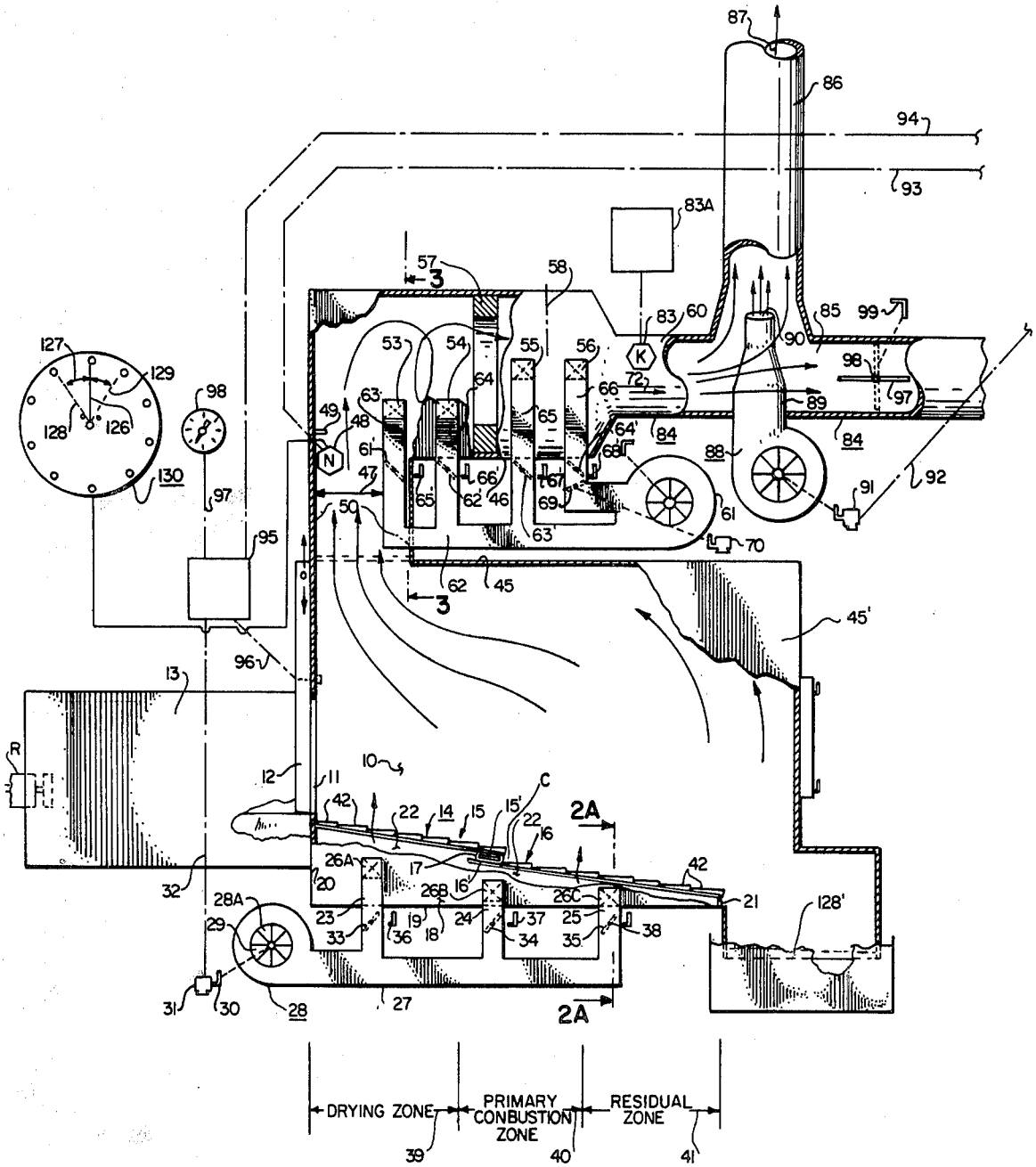
FIG. 1 is a side elevation of an incinerator structure according to the present invention. For convenience of illustration the figure is broken away partially and shown schematically in certain areas.
Figure 2:
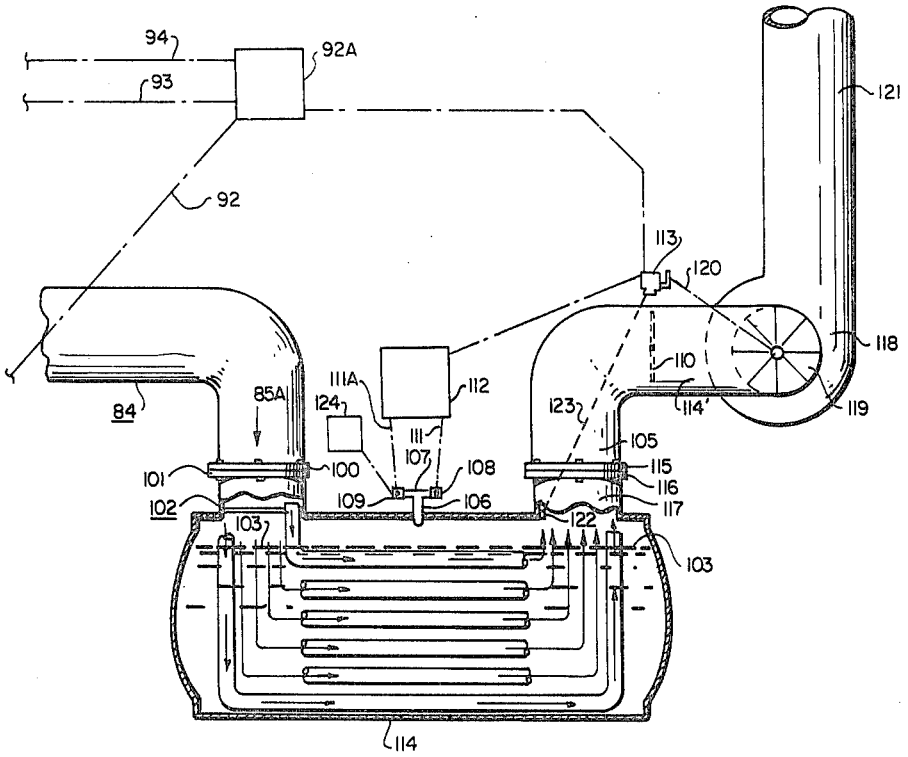
FIG. 2 is a continuation of the structure of FIG. 1, illustrating somewhat schematically the boiler structure associated with the incinerator, this with the exhaust stack for the gases heating the liquid in the boiler.

At the outset,it is understood that the co-inventors herein have a pending patent application in the U.S. Patent Office entitled Reciprocating Grate Systems for Furnaces and Incinerators, Ser. No. 06/390,326, filed June 21, 1982. This application and the disclosure therein is fully incorporated by way of reference in the present case.

Accordingly, in the drawings herein the furnace 10 has an inlet 11 provided with guillotine-type door 12 to which the input feed area 13 is accessible. A push-type cylinder ram R may be incorporated for introducing the feed, garbage, or debris through the opening 11 when door 12 is raised. All of this is described in the above-referenced patent application.

Correspondingly, the present furnace 10 may include a supported movable grate structure 14 taking the form of upper and lower grates 15 and 16 which may have a series of side-by-side disposed, oppositely moving flights, effecting the spreading, mixing and gradual advance of debris such as municipal waste or garbage over the grate structure 14 from left to right to advance toward the lowermost right portion of such grate. The details of the grate structure with the supporting structure and reciprocating means may be the same as that described in detail in the aforementioned patent application. Suffice it to say here that the feed material, in being advanced through the opening 11 will continue to advance slowly along and over grate structure 14 so that the same has ample opportunity to be subjected to combustion in a manner as hereinafter described. Appropriate air seals at 15' and 16' associated with transverse structure 17, likewise fully disclosed in the above mentioned patent application, may be provided so that in general, somewhat of a plenum is formed between grate structure, the sides and bottom of the furnace, and so forth, likewise fully described in the aforementioned application. Accordingly, opposite sides 18, one being shown in FIG. 1, will be provided together with bottom 19 as well as additional housing or shell structure at 20 and 21. Accordingly, the area 22 can be pressurized by the provision of ducts 23, 24, and 25 which do have openings 26 communicating with the interior plenum area 22. Ducts 23–25 go to and are a part of the manifold ductwork 27 which connects to and communicates with outlet side of blower 28. Blower 28 has an inlet 29 which is schematically shown and controlled as to opening by a damper schematically shown at 30, which is provided damper actuator Modutrol motor 31. The latter is a standard part, one of which is manufactured by the Honeywell Corporation; this motor can be electrically or otherwise controlled by control means 32 so as to progressively open or progressively close the damper associated with the input of primary chamber blower 28. Accordingly, the blower can operate at constant speed if desired; yet, the quantity of air coming into the air and hence introduced into the ducts at 23–25 may be controlled. As an optional approach, a variable speed motor could be used in connection with controlling the pressured air output of blower 28 and such be used to control the speed of revolvement of the blower fan 28A.

In any event, while the air output of the primary chamber blower 28 could be constant, in a highly preferred embodiment of the invention the same is made variable for reasons which will hereinafter be pointed out.

Whatever the output of the primary chamber blower 28, the air outlet of each of the individual ducts 24 may be separately controlled and, preferably preset. Accordingly, dampers at 33, 34, and 35 are inserted within the ducts 23–25, respectively, and are seen to be adjustable and are made adjustable by a manual control 36–38 which are schematically shown in FIG. 1. Accordingly, the individual sets of the respective dampers 33–35 will control the percentage of air supply by blower 28 which is introduced in the respective drying zone, primary combustion, and residual zone areas 39, 40, and 41. At this point, it is well to consider the theory and principles of operation relative to the grate structure 14 and the air supply as hereinabove outlined. Different localities will have municipal or other debris or garbage of differing BTU content. This is largely due to the nature of the materials, and more especially, to the water content or moisture content present. This is not to suggest that municipal garbage, even in a set locality, is homogeneous. Rather, there will be certain types of wet garbage, cloth, and so on of relative moisture, paint cans of high flammability and BTU content when the same is containing paint or lacquers, and also items such as sand and gravel and non-combustible materials such as metals. Notwithstanding this, however, different areas of the country will have municipal waste bearing substantially in moisture, and indeed, in other characteristics. Where the municipal waste of high moisture content is being treated as per the furnace installation of the subject invention, then there is required a rather substantial draft of air at duct 23 and opening 26A whereby a substantial amount of air can come through to penetrate satisfactorily the thickness of the garbarge at this point, and more especially, to dry the same over a considerable course length of the debris-travel down the grate structure. Accordingly, in such areas, a rather substantial percentage of input air is conducted through duct 23, as by more or less completely opening the damper at 33, whereby to provide sufficient air to penetrate the garbage and to dry the same in a satisfactory manner. In this regard the various grate plates as at 42 as seen, for example, may comprise rough castings with a high nickel content and which by virtue of their nature will exhibit air openings between adjacent surfaces or edges of adjacent grate plates 42. Furthermore, slight air cracks may appear as between different flights of the upper and lower grates at 15 and 16; see a complete description of possibly used flights in the above-referenced patent application. Accordingly, even though an essential plenumed air supply is at 22, there will be cracks or air admittance apertures through the composite grate structure so that air below the grate structure may proceed through the grate to supply combustion air as well as to dry the materials at the drying zone 39.

Accordingly, when damper 33 is set for a maximum input of air, the other dampers 34 and 35 will be more nearly closed. In practice, for a general municipal waste area, the percentage of air coming from the primary chamber blower 28 and through opening 26A to interior plenum area 22 will approximate about 30%; the majority of the air, approximately 50%, will proceed through opening 26B so as to be effective to achieve primary combustion at primary combustion zone 40. This is where a majority of the materials being processed will be subjected to the combustion process. Finally, at residual zone 41, there is desire to be merely a deep red glow of the remaining embers or materials that have been through the primary combustion process, whereby a minimum of draft and particulate entrainment will occur proximate this zone 41. Hence, damper 35 will be merely closed and admit only perhaps 20% or less of the input air from the blower 28.

All of these matters are related essentially to the balancing of the system for optimum operation. For input materials which are less moist, then the air coming through duct 23 can be lowered as to volummetric throughput; thus additional air can be supplied to the primary combustion zone 40 and, if desired, a slight increase at residual zone 41.

Primary chamber 42 of FIG. 10, seen disposed above grate structure 14, maintains a slightly negative pressure relative to ambient atmospheric conditions to the feed area 13 and also, of course, relative to the overall air pressure of plenum area 22. Thus, the overall air pressure at interior plenum area 22 will be greater than at feed area 13. A convenient operating negative pressure for primary chamber 42 will be approximately from one-tenth to two-tenths of an inch water column. This pressure should be approximately 10% over prevailing atmospheric pressure, but it should be noted that never must a situation exist wherein the pressure within primary chamber 42 is greater than atmospheric pressure, since this would cause a very severe fire danger and where the door 12 is opened, a rapid blast of flame outwardly into the feed area to create a great hazard. Since there is only slight leakage of plenum air through and around the grate structure, there will be essentially no danger of plenum air going directly to the feed. However, and depending upon design considerations, of course, the pressure in the various areas can be controlled so that the progression from lowest to highest air pressure will be from primary chamber 42, to plenum chamber 22, to feed area 13.

It has been previously discussed that the drying zone is primarily for the drying off of vapors including water vapors and, further, that the residual zone simply completes combustion but at a very reduced temperature so as to avoid flame drafts and consequential entrainment of particulate matter in the air. Accordingly, the air currents to the right in primary chamber 42 will be reduced to a bare minimum. In fact, the entire furnace may be operated at somewhat of a starved-air condition only 50% of the stoichiometric air, or air-required-to-complete-combustion is supplied primary chamber 42. This is for the purpose of reducing flame and consequent flame draft in the primary chamber. Rather, at the primary chamber the combustible solids are burned; however, there is a great deal of carbon monoxide and other gases formed which are later subjected to complete combustion in secondary chamber 44, which is disposed above and isolated therefrom by primary chamber top wall 45 and secondary chamber bottom 46. Indeed, the only communication between the primary and secondary chambers will be through the opening 47.

Figure 3:
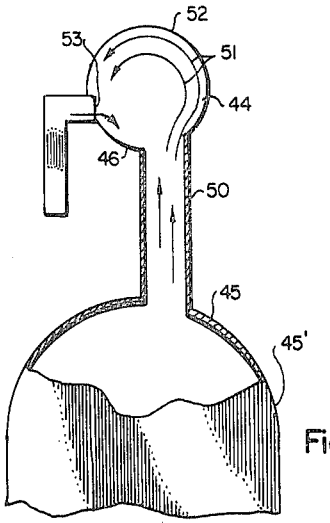
FIG. 3 is a transverse section of the primary and secondary chambers of the incinerator structure, connected by an essentially venturi passageway for conducting gases from the primary chamber to a secondary chamber for mixing and combustion.
Figure 2A:
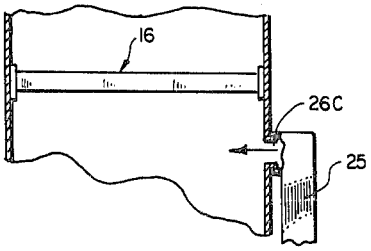
FIG. 2A is a transverse cross-section and is shown as an enlarged framentary detail, being taken along the line 2A—2A in FIG. 1.

Opening 47 is a constricted area including a control 48 comprising in part a pitot tube 49. This passageway at 47 serves a venturi which effects a squeezing together of the rising vapors and gases and produces a reduced pressure area at 47, this to cause a sufficient but not improper draft into secondary chamber area 44 as well as to effect a completion for the draft movement and exhaust from the primary chamber into the area at 47. Again, it is desired to keep fine particulates, ashes and the like, confined as much as possible into the grate area for exhaust or even for dropping through the grate to be expelled by a dragline mechanism as is indicated and disclosed in the above-referenced patent application. Accordingly, air movement through the primary chamber must be minimized to that required to conducting the smoke and gases to the secondary chamber 44; yet, it must be sufficient to produce the negative pressure needed in the primary chamber 42 so as to preclude fire hazard to the exterior and also to provide a sufficient conduction of air from the plenum area through the grate structure. Structure 50 forms the venturi chamber 47 and provides the air and gas passageway from the structural shell 45' of the primary chamber to the bottom 46 of the secondary chamber. See FIG. 3. It is to be noted that the admittance through chamber 50 to secondary chamber 44 is disposed off-center. See FIG. 3. This is for producing a swirling motion of smoke and carbon monoxide and other gases and vapors in the direction of the arrow 51. There will be provided at the upper chamber 44 as defined by the shell 52, of which bottom 46 forms a part, a series of air inlet ports at 53–56. This is for producing additional air and hence additional oxygen to those gases and smoke coming into the chamber 44, whereby the additional oxygen will either aid in the immediate combusion of materials entering into the chamber or aid additional burners inplaced in such secondary chamber to effect the complete combustion of materials therein, at least as to the combustible materials such as carbon monoxide present thereat.

Accordingly, the swirling motion of the gases and the introduction of air at 53–55 effects a complete swirling and mixing materials so as to effect as complete a combustion as possible. There will be a ring-type semi-baffle at 57 so as to constrict the gases and obtain a thorough mixing of smoke, any particulates present, and gases, so as to prepare for a final combustion at port 55. By the time area 58 is reached, essentially a complete combustion will have been obtained of all combustible gases and materials in the secondary chamber. The inlet port 56 serves really as a temperature control and cools slightly the resultant gases at area 56 prior to the gases routing through passageway 60. Secondary chamber blower 61 is provided and includes a primary manifold ductwork 62 having ducts 63–66 leading to input ports 53–56 associated with secondary chamber 44. The individual ducts 63–66 are likewise supplied with their individually, preferably manually controlled dampers at 61'–64' which are themselves provided with manual controls, schematically shown at 65'—68'. Accordingly, the manual controls may be manually preset and adjusted in accordance with the specific air requirements needed at ports 53–56 for balancing the system and for appropriately cooling, as to port 56, the gases flow from area 58 leading into chamber 60. Finally, there will exist an automatic control at 69 which is controlled by damper actuator 70 which will be hereinafter discussed. Suffice it to say at this point, the system as to the upper chamber 44 can be balanced by the setting of the various dampers 61'–63' so as to effect a proper and complete combustion of materials. Likewise, damper 68 can be controlled for a given percentage of air input from the blower 61 so as to appropriately cool the gas stream proceeding to the left in the direction of the arrow 72 in the chamber 60. Notwithstanding these presettings it may be desired to introduce even more or less air for a given temporary condition, in which event the damper actuator control which can be the Honeywell Modutrol motor, an off-the-shelf item, can be incorporated. To this effect, a thermocouple 83 may be incorporated within the chamber 60 proximate arrow 72 so as to sense the temperature of the gas stream at this particular point. The thermocouple can be used by suitable electrical means, not shown, for adjusting the damper actuator 70 so as to permit more or less air to enter the port 56, depending upon whether a slight temperature reduction or a slight temperature increase is needed relative to the gas stream at 72 and 60.

Teed into the conduit structure forming passageway 60 and 85 is a dump stack having upstream exhaust passageway 87. At the base of the dump stack is an ejector fan or blower 88 provided with a composite shroud and blower ejector conduit 89 provided with orifice 90. This blower is controlled as to input with a damper actuator 91 controlling the input to the blower. Damper actuator is a standard part and may be controlled by electrical circuit, pneumatic circuit, or other means at 92–98 for suddenly supplying as needed pressure flow upwardly through the stack 86 so as to markedly increase the draft and exhaust, either suddenly and completely, or incrementally, the needed gas flow approaching the stack area at 60 in the drawings. Specifically, the ejector blower at 88 will be designed to create a complete exhaust of gases and any air entrained particles from passageway 60 upwardly through the stack or, where desired, a division of flow as between the stack and passageway 85. Accordingly, the ejector blower 88 is employed to detect marked pressure changes sensed by pitot tube 49, for exmaple, as might be created by the opening of the feed door, as to drastically increase the draft through passageway 47 and hence preclude a fire hazard should the pressure in the primary chamber 42 and at area 47 suddenly increase. Likewise, and as hereinafter to be pointed out, there may be a steam demand change of gradual progressive or even of a sudden nature.

At this point, and continuing on with the structure, it should be observed that a large damper at 97 is employed and is pivotal about axle 98. This is preferably a manually adjusted damper that takes a period of time to adjust from closed to opened position. It can be set by control 99 in the usual manner. The purpose for this damper to preclude thermal shock to the boiler system later to be described and subsequent structure when the system is started up. Accordingly, when the structure to the right of damper 97 is cold, the furnace will be heated up and all of the gases will be essentially exhausted up the stack as by the control of secondary blower 88, and the damper 97 is progressively opened slightly until it achieves a gradual full open condition. Incoming hot gases into the passageway 85 will be gradually increased as to volume so as to heat gradually the boiler area later to be described. Once the structure is sufficiently preheated then the damper 97 can be opened to a full-opened condition as shown in FIG. 1.

Continuing on with the structure and its description, structure 84 incorporates a flange 100 which is bolted or otherwise secured to flange 101 of boiler structure 102. The boiler structure 102 includes a water level 103 whereby water or other fluid is disposed exterior to the tubes, partially shown in dotted lines which receive the descending gases from passageway 85A. So far as the boiler is concerned, either the tubes shown conduct the gases to passageway 105, or the gases can simply heat liquid-conducting tubes in a heat-exchange relationship. The former is deemed most desirable since in a fire-tube boiler as herein shown, the same is more efficient since it would be easier to clean the inside surfaces of the tubes rather than to clean periodically an exterior-tube-surface and interior heat exchange area conducting the gases. In any event, there is a heat exchange relationship which exists as between descending gases at 85A and the water used to produce the steam at 106.

Whatever the precise heat exchange construction, steam at 106 proceeds into a tee 107 which incorporates two controls, one at the right at 108 and one on the left at 109. The control at 108 is preferably a Honeywell differential-pressure transmitter which controls a damper 110, and 109. Control 109 adjusts conditions where the steam generated at the boiler cannot be handled or used by any exterior system producing power for example. Accordingly, when a condition of excess steam production is sensed at 109, then the control at 108 effects a control of damper 110. This is provided through the system 111, 112, and 113, the latter comprising a spring return damper actuator, preferably Honeywell Modutrol motor or similar item. The damper 110 is designed so as to close automatically under spring pressure in the absence of a reverse force applied by the acutuator 13. Accordingly, during conditions of operation of proper steam pressure for the demand requirement of the external system, the damper can be opened and in fact will remain opened. In addition, this damper at 110 can be closed immediately by electrical, heat sensing or other means so that if an emergency occurs at the boiler, the damper at 110 can be closed immediately so as to fully shut off the flow of gases to the boiler and hence immediately reduce and subsequently eliminate the production of steam at the steam boiler 114.

Structure 114' is a conduit structure coupled by flanges 115 and 116 to the gases exhaust passageway 117 of the boiler structure 114. It will be observed that the boiler structure will be constructed such that all of the steam will proceed upwardly at 106, whereas all of the gases effecting the heat exchange relationship will be conducted upwardly through the passageway formed by structure 117 and 105. Structure 114' forms the input for a blower or fan 118 incorporating a fan component 119 actuated by control 113 as is evidenced by system line 120. The blower or fan at 119 accordingly exhausts the incoming gases upwardly through primary stack 121.

In operation, suppose a condition exists such that there is a low water condition in the boiler at 115 and this structure starts to heat up. In such event a thermocouple at 122 could be employed and be coupled to the control 113 so as to cause the damper 110 immediately to close, thereby shutting off the conduction of gases through the tubes in the fire tube boiler used. This is indicated schematically by dotted line 123. Finally, and as has before been indicated, the system including the elements at 108 and 109, in combination with system components 111A and 112, may be employed in conjunction with the damper actuator 113 so that if feed demand is reduced by external system 124 such as an electrical steam generator, as coupled to a steam receiving unit 106, then control 109 can sense this condition and immediately instruct and operate in tandem with control 108 so as to automatically control damper 110. As to the various components forming the structures at 124, 108, and 109, these are conventional and may comprise process pressure transmittors manufactured by the Honeywell Corporation as suitable demand controller going under the name Dialatrol in the industry.

It is noted that our system can be operated either as a primary or as an auxiliary source of steam for an external system requiring such as at 124.

It is to be noted again that either a water tube boiler or a fire tube boiler could be used to generate the steam at 114.

A suitable control panel, computerized or otherwise, can be employed to include the control at 112 as well as other controls in the system.

Unit 113 supplies a power close as to damper 110 which again is spring biased to the closed position.

It is noted that one of the principal functions of the dump stack 86 is as an emergency control, this utilizing the ejector blower 88 and the controls associated therewith. Note that the present invention will provide an automatic control of draft up through the dump stack for this to provide a regulating check and hence a control at the pressure at the venturi passageway 47.

For completely satisfactory operation of the system, it is appropriate to control the temperature of the gas stream proximate passageway 85 such that there is a number of variation greater than 50° F. This is usually very difficult to do because of the difference in BTU content of input debris being incinerated.

The present invention accomplishes by using what is known in the industry as a photo-helic gauge as seen in FIG. 1. The same includes a central needle and central arm 126 which moves back and forth in the direction of the arrow 127. A pair of needles at 128 and 129 are set as desired and may be rotationally displaced toward or away from each other so as to allow an appropriate operating zone for needle 126. This gauge is coupled to the pitot tube 128 to sense pressure at the pitot tube 149. These needles are manually present so that the system can operate within the pressure deviation range desired at opening 47. For example as to water column (w/c) as a standard, the needle on the left should be set perhaps to a minimum of negative 0.05 w/c with the upper needle 129 being set at negative 0.2 w/c ins. Arm 127 will fluctuate and be responsive to the particular negative pressure existing at any time at pitot tube 49. The gauge will send a signal to control 91 which controls the input and hence the output of ejector blower 88. It is noted that the pitot tube 49 may corrode and its orifice may become constricted over a period of time. It is likewise to be noted that it is easy to adjust the gauge 130 by moving the movable needles 128–129 to compensate for any slight pitot tube closure. The final result is that blower 88 will control the proportion or ratio of the gases coming from passageway 60 going through the dump stack and also proceeding through passageway 85 so that this blower indirectly affects gas temperature at 85. Hence, the less volume of gases proceeding through passageway 85, the lower the temperature will be. This is particularly true and effective in combination with the pre-temperature control of such gases at 56 as was explained in connection with the controlled operation of automatically controlled secondary blower 61.

The water seal at 128' in combination with the closed chamber structure relative to primary chamber 42 minimizes draft and air currents over the residual zone 41. This is where the particulates will congregate. The temperature here is maintained so that there is a very low flame and coals, such that the likelihood of particulate entrainment is reduced as well as minimizing eddy current circulation as to even chance the possibility of such entrainment. A suitable spent-materials removable system such as a drag line or screw conveyer may be incorporated in the water below water level 128'.

By virtue of controlling the inlet air to the various blowers, these blowers can be run for operated constant speed fan revolvement. While fan revolvement could be varied, it is believed that this is the better system and much less expensive as well as supplying greater ease for control.

The tumbling of incoming materials at area C accomplishes not only a distribution of materials but also a mixing of air with the air so as to make more efficient the combustion process in the combustion zone 40. It is noted that since the venturi zone at 47 is located at the front of the unit, a tremendous amount of water vapor is eliminated even before the combustion zone at 40 is reached. This reduces corrosive effects within the primary chamber as well as insures that the reduced particulates which become more pronounced in volume as the combustion process proceeds, are less present at the drying zone and hence will be less subject to entrainment of any drafts proceeding through passageway 47.

Control 98 simply is a monitoring control and may be manually set proper combustion rate. This control can be overridden during a feed cycle for reducing air infiltration and pressure surges as when the door is opened for short periods of time. Control 92A can be an ejector damper negative pressure bandwidth controller. Also, pressure-sensitive electrical means intercouple the pitot tube 49 with the control 130.

Item 83A is a secondary chamber proportioning controller such as a Modutrol.

It is to be noted by virtue of the venturi tube sensing feature, the tube can sense pressure and hence gas flow through this area. It is essential that the flow be regulated and reduced to a minimum to avoid particulate entrainment in the upwardly traveling air stream; yet, the pressure should be regulated at area 47 to provide for appropriate combustion and associated effects within the system.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

We claim:

1. An incinerator including, in combination: a housing having an ingress opening and a terminal egress; an overfeed grate system supported within said housing and comprising upper and lower, longitudinally aligned, declining, end-overlapping, longitudinally movable grates, said housing having a floor disposed beneath said grate system and opposite sides upstanding from said floor and enclosing said grate system, said housing also having a transverse structure disposed between and forming, substantially, air seals with said upper and lower grates proximate the end overlap thereof; means for introducing debris to be incinerated onto a forward end of said grate system for advancement toward the rearward end thereof, said grate system being air-pervious but forming with said housing a plenum beneath said grate system and a primary chamber above said grate system; a manifold ductwork having plural, mutually spaced branch ducts, said housing having mutually-spaced, air-admittance apertures communicating with the interior of said plenum and respectively coupled to said branch ducts; and blower means coupled to said manifold ductwork; wherein said branch ducts each have respective adjustable dampers and said housing includes depending, vertically open structure having terminal water seal means disposed rearwardly of said ductwork and said grate means.

2. The structure of claim 1 wherein said blower means is provided with variable air input means.

* * * * *